US011981404B2

(12) United States Patent
Tegeder et al.

(10) Patent No.: US 11,981,404 B2
(45) Date of Patent: May 14, 2024

(54) INFLATABLES HAVING FLAT SEGMENTS WITH BENDS

(71) Applicant: Lakesurf, LLC, Murrieta, CA (US)

(72) Inventors: Troy Tegeder, Winchester, CA (US); Stephen Hale, Winchester, CA (US)

(73) Assignee: Lakesurf, LLC, Murrieta, CA (US)

( * ) Notice: Subject to any disclaimer, the term of this patent is extended or adjusted under 35 U.S.C. 154(b) by 417 days.

(21) Appl. No.: 17/467,579

(22) Filed: Sep. 7, 2021

(65) Prior Publication Data

US 2023/0073982 A1 Mar. 9, 2023

(51) Int. Cl.
*B63B 7/08* (2020.01)
*A45F 3/22* (2006.01)

(52) U.S. Cl.
CPC . *B63B 7/08* (2013.01); *A45F 3/22* (2013.01)

(58) Field of Classification Search
CPC ..... B63B 7/00; B63B 7/08; A45F 3/00; A45F 3/22; A47G 9/00; A47G 9/06
USPC ..... 114/345
See application file for complete search history.

(56) References Cited

U.S. PATENT DOCUMENTS 2,623,574 A * 12/1952 Damsch ..... A47C 1/146 441/129
5,560,056 A * 10/1996 Tai ..... A45F 3/22 441/129
6,981,287 B1 * 1/2006 Chen ..... A47C 27/081 5/733

* cited by examiner

*Primary Examiner* — Lars A Olson
(74) *Attorney, Agent, or Firm* — Kirton McConkie; Brian Tucker

(57) ABSTRACT

Inflatables can have one or more flat segments that are configured to form one or more bends. The flat segments of the inflatables could be formed using any technique such as drop stitch. One or more bends may be maintained in one or more flat segments of an inflatable such as to create a ladder and a slide. A variety of bend maintaining components can be used to maintain the one or more bends.

20 Claims, 14 Drawing Sheets

INFLATABLES HAVING FLAT SEGMENTS WITH BENDS

CROSS-REFERENCE TO RELATED APPLICATIONS

N/A

BACKGROUND

Drop stitch construction is commonly used for inflatables, such as paddle boards, to form flat surfaces. With drop stitch construction, top and bottom sheets of fabric are joined together along parallel planes using many equal length stitches to thereby form a core. This core can be coated in one or more thin layers of PVC to make it air and water impermeable while retaining its flexibility. A sidewall can also be connected between the top and bottom sheets of fabric to form an enclosed, inflatable article. Because the two sheets of fabric are joined together by equal length stiches, the top and bottom sheets will remain flat even when the core is inflated to high pressures. Other techniques also exist for creating inflatables with flat surfaces such as internal baffles spanning from the top sheet to the bottom sheet. These methods of construction typically limit the inflatable to a single flat configuration when inflated.

BRIEF SUMMARY

The present invention is generally directed to inflatables having one or more flat segments that are configured to form one or more bends and to techniques for forming and maintaining such bends. The flat segments of the inflatables could be formed using any technique such as drop stitch. One or more bends may be maintained in one or more flat segments of an inflatable such as to create a ladder and a slide. A variety of bend maintaining components can be used to maintain the one or more bends.

An inflatable configured in accordance with one or more embodiments of the present invention can be selectively converted between a mat configuration and a slide configuration. When in the mat configuration, the inflatable can be placed on water to allow individuals to stand and play on the inflatable. When in the slide configuration, the inflatable can be secured to a boat or other structure overtop the water to allow individuals to slide into the water. The inflatable can be configured to enable a bend to be maintained between a slide end and a ladder end to thereby transition the inflatable from the mat configuration to the slide configuration.

In some embodiments, multiple bends could be maintained in one or more flat segments of an inflatable. For example, two bends could be maintained in a flat segment of an inflatable to create a ladder end, a horizontal portion and a slide end.

In some embodiments, the present invention may be implemented as an inflatable that includes a flat segment having a top, a bottom and a sidewall that extends between the top and the bottom, and one or more bend maintaining components for maintaining one or more bends.

In some embodiments, the inflatable may include one or more additional flat segments each having a top, a bottom and a sidewall that extends between the top and the bottom.

In some embodiments, the one or more bend maintaining components are removable to cause the flat segment to remain flat.

In some embodiments, the one or more bend maintaining components comprise one or more bend maintaining straps for maintaining the one or more bends in the flat segment.

In some embodiments, the one or more bend maintaining components comprise one or more angle bars in the sidewall for maintaining the one or more bends in the flat segment.

In some embodiments, the one or more bend maintaining components comprise one or more sheets of material for maintaining the one or more bends in the flat segment.

In some embodiments, the one or more sheets of material have a triangular shape.

In some embodiments, the inflatable may include two or more flat segments, and the one or more bend maintaining components may be one or more wedges that connect flat segments to each other to create and angle between the connected flat segments.

In some embodiments, the one or more bend maintaining components maintain more than one bend in the flat segment.

In some embodiments, the inflatable may include one or more bend locating components.

In some embodiments, the one or more bend locating components may include one or more bend locating straps secured to the bottom of the flat segment and positioned at an interface between a first portion of the flat segment and a second portion of the flat segment, and one or more bend locating rings secured to the bottom of the flat segment and positioned at the interface opposite the one or more bend locating straps. The one or more bend locating straps and the one or more bend locating rings may be configured to locate a bend in the flat segment of the inflatable along the interface.

In some embodiments, the inflatable may include stiffeners that are secured to the bottom of the flat segment and positioned on opposite sides of at least one of the one or more bends.

In some embodiments, the stiffeners may include multiple pairs of stiffeners that are spaced apart to create at least one gap for accommodating a fold line.

In some embodiments, the inflatable may include one or more tie off points secured to the bottom of the flat segment.

In some embodiments, the inflatable may include one or more sidewall protectors positioned on or in the sidewall of the flat segment at a location of at least one of the one or more bends.

In some embodiments, the one or more bends convert the flat segment of the inflatable into a slide.

In some embodiments, the inflatable may include a pad secured to the top, the pad including one or more ridges to enable the pad to function as a ladder.

In some embodiments, the present invention may be implemented as an inflatable that includes a top, a bottom, a sidewall that extends between the top and the bottom and at least one bend maintaining component that maintains a first bend. The first bend creates a slide portion on one side of the bend. In some embodiments, the first bend also creates a ladder portion on the opposite side of the bend from the slide portion.

In some embodiments, the present invention may be implemented as an inflatable that includes a top, a bottom, a sidewall that extends between the top and the bottom, one or more bend locating components for locating one or more bends, and one or more bend maintaining components for maintaining the one or more bends.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION

The term "segment" will be used to reference an individual walled off portion of an inflatable. A flat segment would therefore be a segment that is constructed to be flat when inflated. The term "bend" will be used to reference either an angle formed in a flat segment or a change in angle between two adjacent flat segments of an inflatable. Embodiments of the present invention will be described primarily in the context of an inflatable having a single flat segment that can be converted between a mat and a slide. However, embodiments of the present invention encompass a variety of inflatables having any reasonable number of flat segments and possibly non-flat segments that can be configured to maintain one or more bends in one or more flat segments or between adjacent flat segments to selectively form other toys or structures.

In the context of embodiments of the present invention, an inflatable may have one or more inflatable flat segments that include internal supports that constrain a top and bottom of the flat segment to be substantially flat and parallel to one another. A flat segment of an inflatable may commonly be formed using drop stitch construction, but other techniques exist and are encompassed by embodiments of the present invention. In some embodiments, in addition to one or more flat segments, an inflatable could have one or more segments that are not configured to be flat. In some embodiments, all segments of an inflatable, whether or not the segments are flat, could be inflated together, while in other embodiments, at least one of the segments of an inflatable could be separately inflated.

The term "bend locating component" should be construed as any suitable structure by which a bend is located in a flat segment of an inflatable. A bend locating component typically functions to cause a bend to be formed in a particular location of the flat segment of the inflatable while the inflatable is being inflated. One or more bend locating components may be used to locate a bend. Examples of bend locating components include rings, straps, a zipper, etc.

The term "bend maintaining component" should be construed as any suitable structure by which a bend is maintained in a flat segment of an inflatable. A bend maintaining component functions to cause a bend to be maintained after the inflatable is inflated including during use/play. One or more bend maintaining components may be used to maintain a bend. Examples of bend maintaining components include straps, angle bars, an angled sheet of material, a wedge, etc.

Figure 1B:
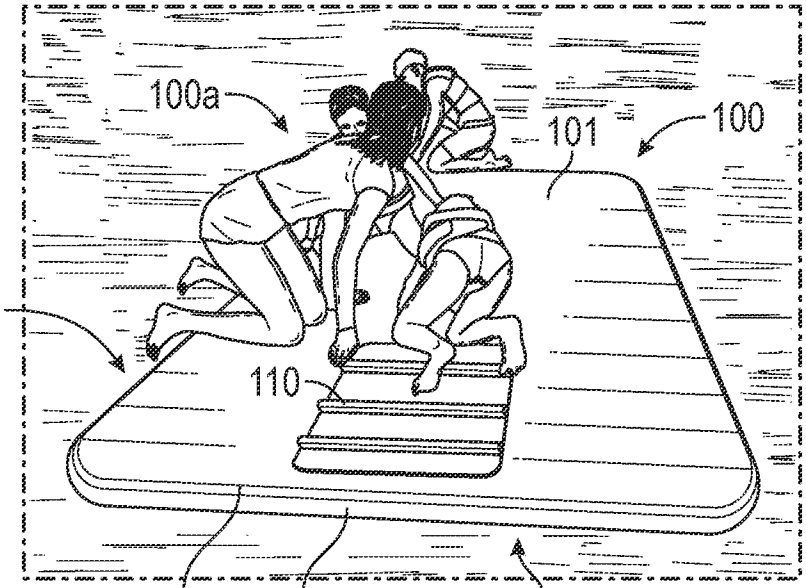
FIGS. 1A and 1B provide examples of an inflatable when used as a mat in accordance with one or more embodiments of the present invention.
Figure 1A:
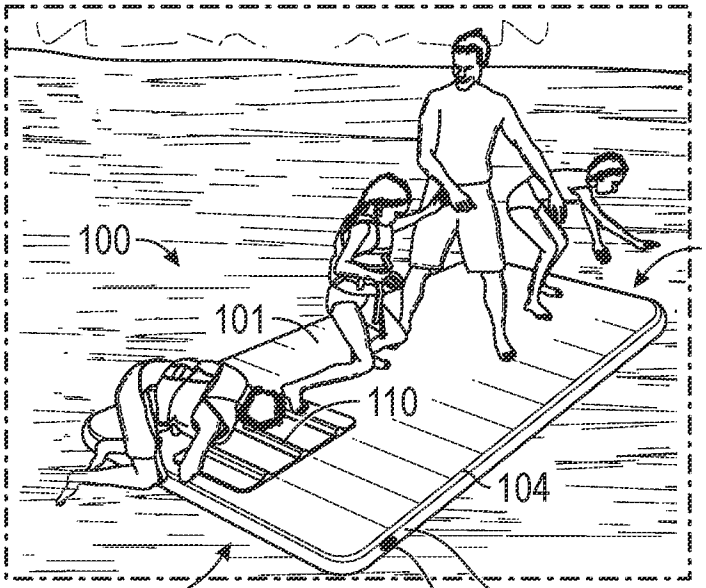

FIGS. 1A and 1B illustrate an inflatable 100 having a single flat segment that is configured in accordance with one or more embodiments of the present invention. Inflatable 100, or its single flat segment, includes a top 101, a bottom 103, and a sidewall 102 that is connected between top 101 and bottom 103. Top 101 and bottom 103 may be formed using drop stitch construction, internal baffling that connects top 101 and bottom 103 or another technique that causes top 101 and/or bottom 103 to form a flat surface. For example, top 101 and bottom 103 may be part of a 10 cm single layer drop stitch core. However, top 101 and bottom 103 could be formed using any other drop stitch construction technique, dimension and/or configuration (e.g., fusion, double layer, etc.). In some embodiments, sidewall 102 may be formed of PVC coated nylon, although any other suitable material could be used. In some embodiments, the seams between top 101 and sidewall 102 and between bottom 103 and sidewall 102 could be welded and reinforced by tape 104 that is welded over the seams.

Inflatable 100 can be viewed as having a slide end 100*a* and a ladder end 100*b*. Ladder end 100*b* can include a pad 110 that can function as a ladder when inflatable 100 is in the slide configuration. In some embodiments, the top/outer surface of top 101 can be smooth and un-textured to minimize its coefficient of friction when wet. Inflatable 100 may include a valve (e.g., a Halkey-Roberts valve) positioned anywhere in top 101, sidewall 102 or bottom 103.

Figure 2A:
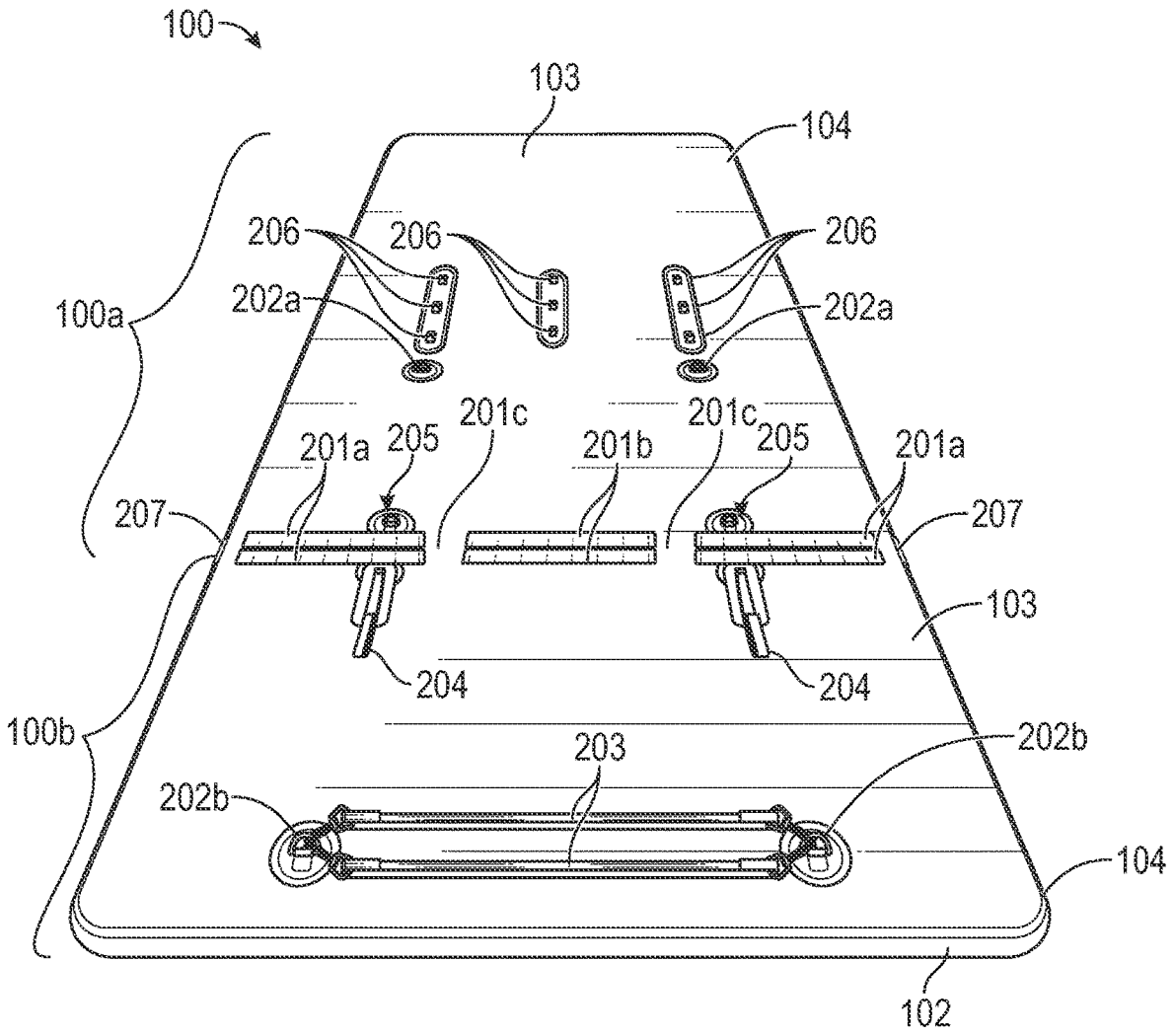
FIG. 2A is a bottom view of an inflatable when in the mat configuration in accordance with one or more embodiments of the present invention.
Figure 2B:
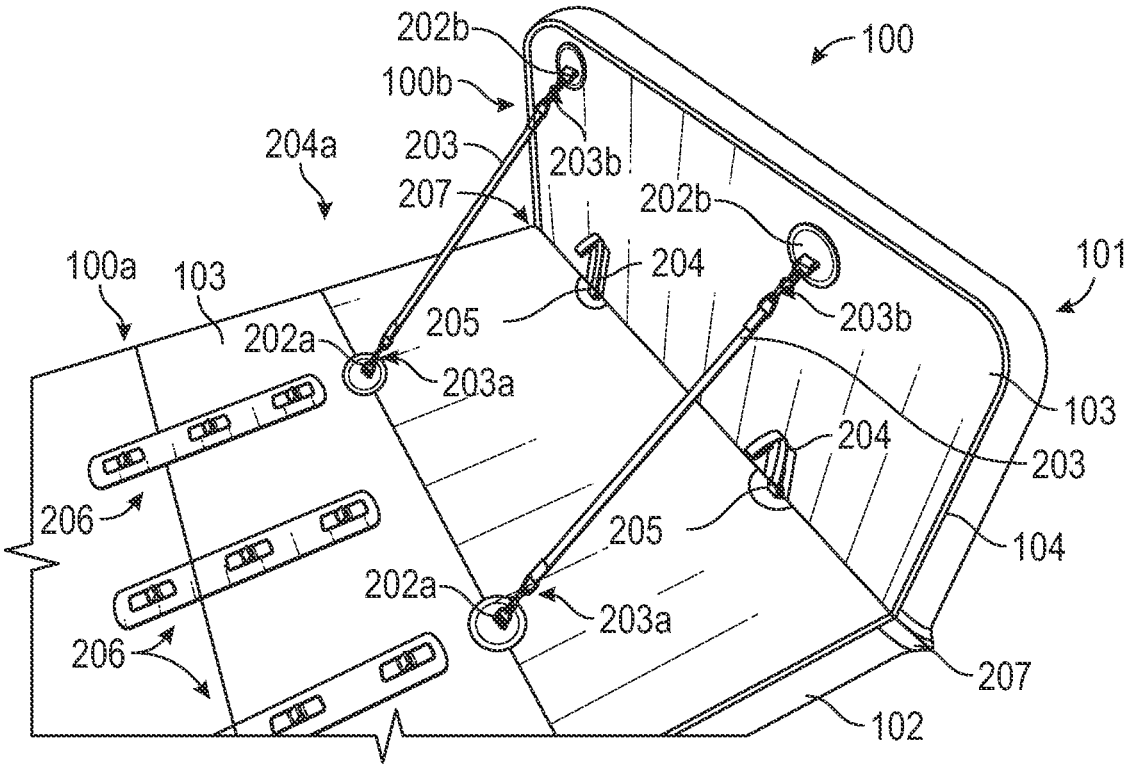
FIG. 2B is a bottom view of an inflatable when in the slide configuration in accordance with one or more embodiments of the present invention.
Figure 2C:
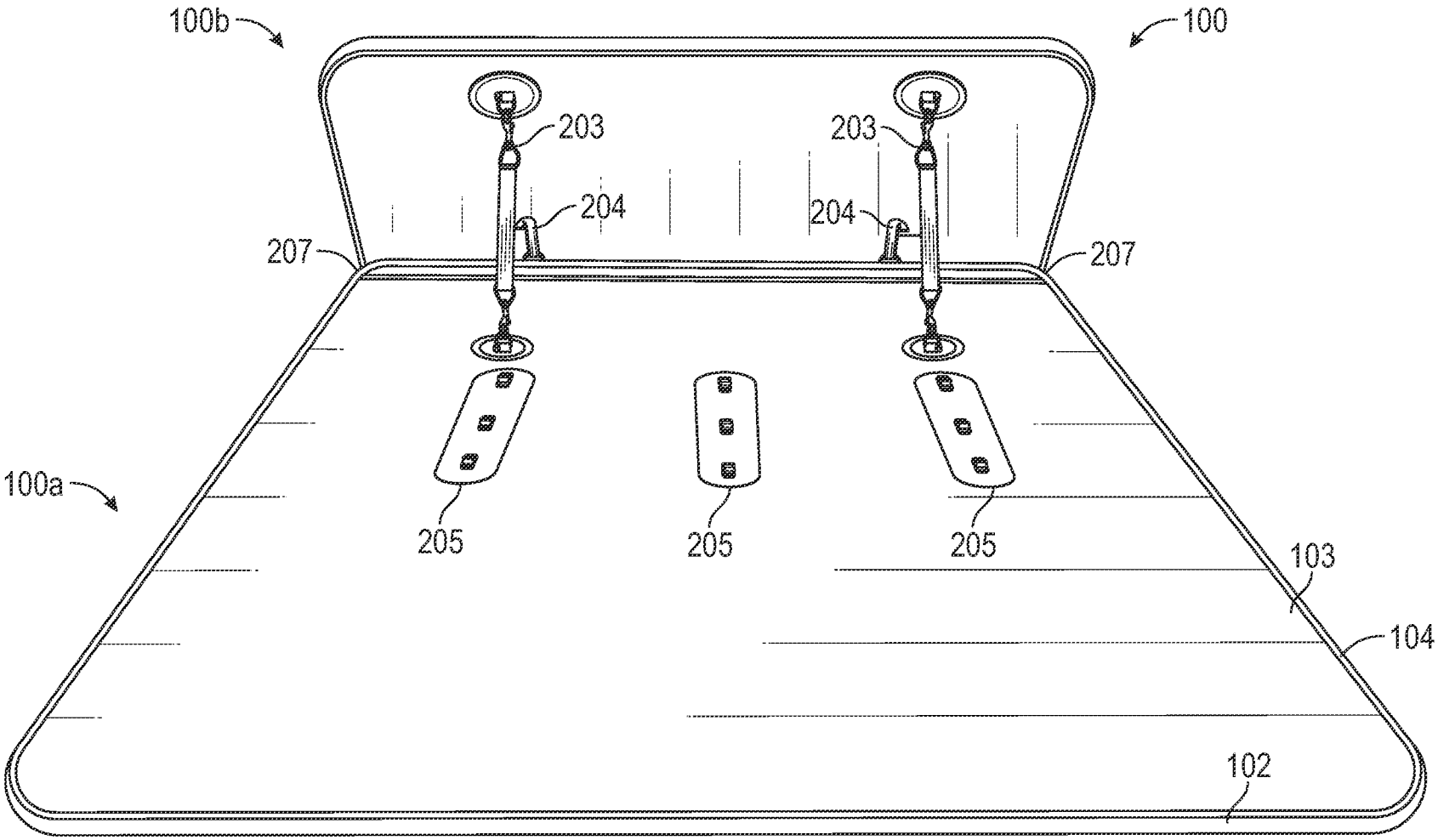
FIG. 2C is another bottom view of an inflatable when in the slide configuration in accordance with one or more embodiments of the present invention.

FIGS. 2A-2C each show bottom 103 of inflatable 100. In FIG. 2A, inflatable 100 is in the mat configuration, while in FIGS. 2B and 2C, inflatable is in the slide configuration. To facilitate the transition between the mat configuration and the slide configuration, bottom 103 may include a number of components and features. For example, outer stiffeners 201*a* and inner stiffeners 201*b* (collectively stiffeners 201) can be secured to bottom 103 (e.g., via welding or gluing) and positioned along the interface between slide end 100*a* and ladder end 100*b*. For example, a pair of outer stiffeners 201*a* can be positioned on opposing sides of this interface towards sidewall 102 and a pair of inner stiffeners 201*b* can be positioned on opposing sides of this interface between the pairs of outer stiffeners 201*a*. Thus, a gap 201*c* may be formed between the pair of inner stiffeners 201*b* and each pair of outer stiffeners 201*a* along which no inner stiffeners extend. Gaps 201*c* can facilitate folding and storage of inflatable 100 as described in greater detail below. Each pair of stiffeners 201 can be aligned along and spaced closely from the interface between slide end 100*a* and ladder end 100*b* to thereby reinforce or stiffen the sections of bottom 103 that extend along this interface. Due to this reinforcement, a straight bend in inflatable 100 can be more easily induced along the interface. In other words, the bend can be induced along the line that extends between the pairs of stiffeners 201.

Figure 3A:
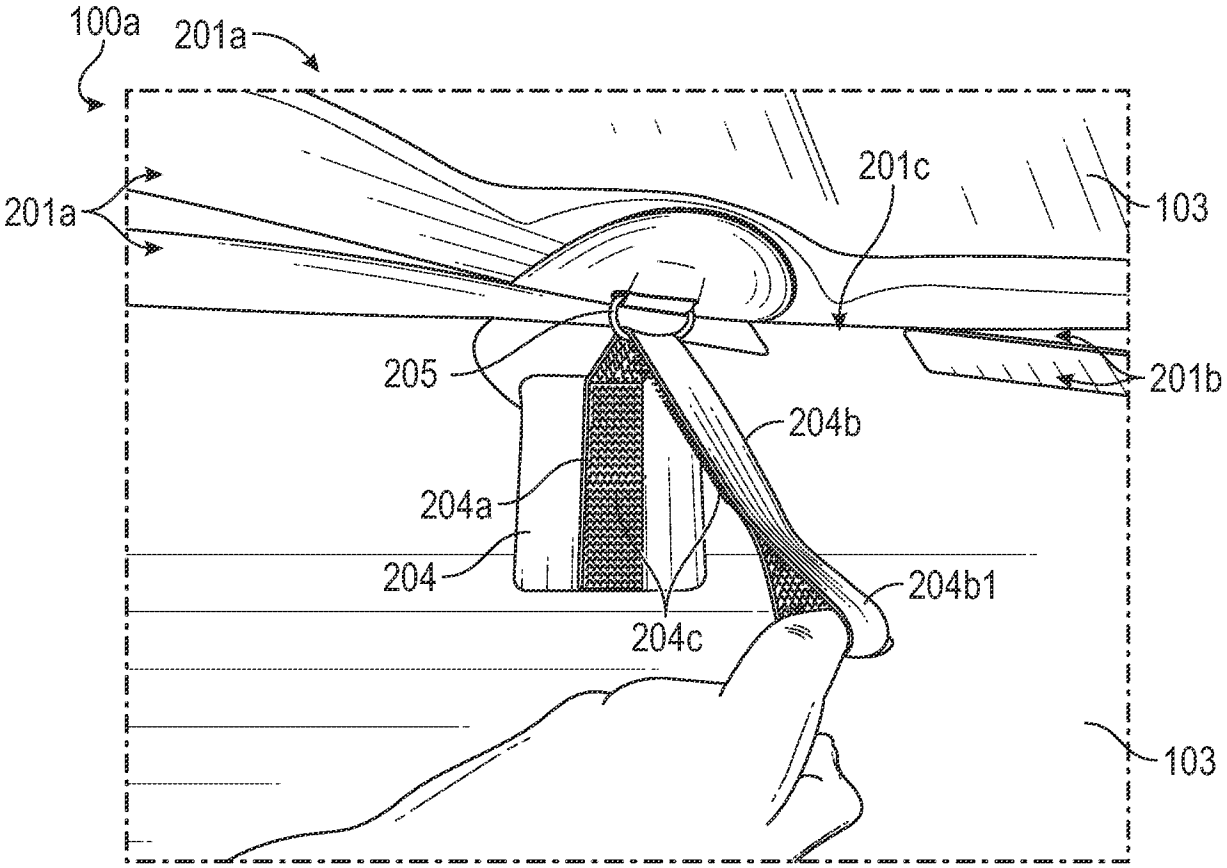
FIGS. 3A-3D provide an example of how an inflatable can be converted from the mat configuration to the slide configuration in accordance with one or more embodiments of the present invention.
Figure 3B:
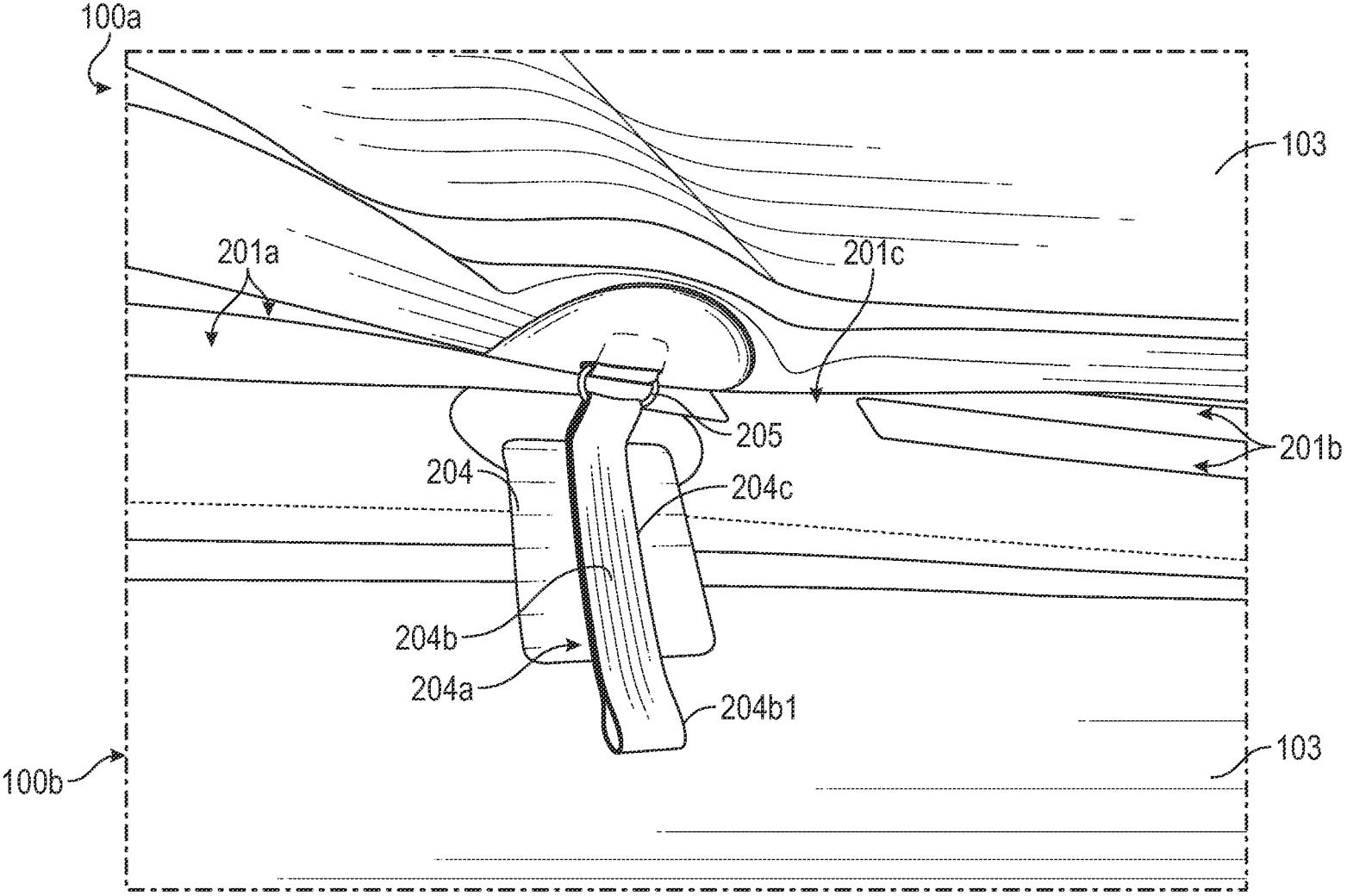
Figure 3C:
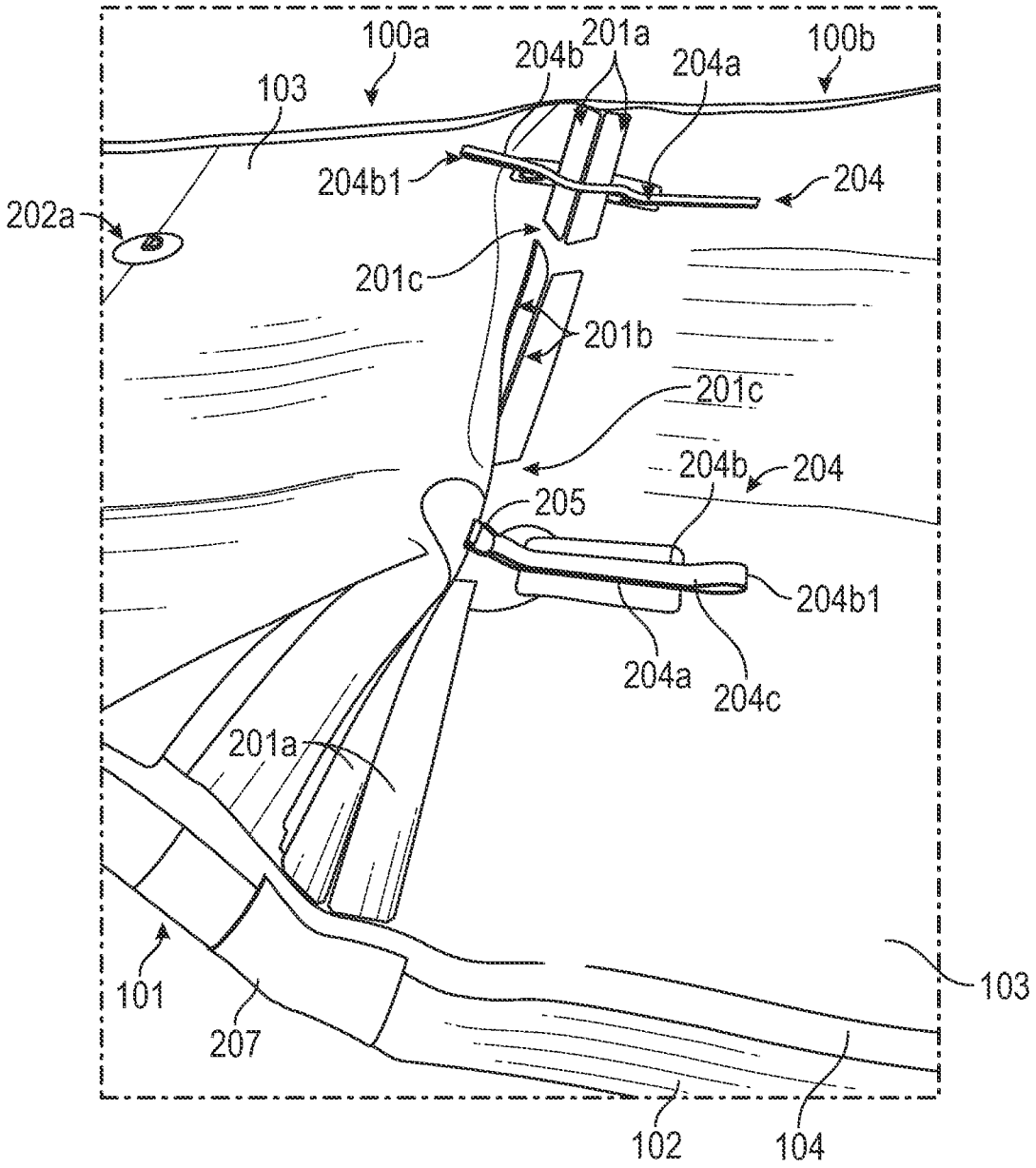

In some embodiments, bend locating components can be included on bottom 103 to cause a bend to be formed in the proper location when the flat segment of inflatable 100 is inflated. For example, one or more bend locating straps 204 and corresponding bend locating rings 205 can be secured to bottom 103 on opposing sides of the interface between slide end 100*a* and ladder end 100*b* and can function to locate a bend at the interface. For example, as is better shown in FIGS. 3A-3C, bend locating strap 204 can include a first portion 204*a* that is secured to bottom 103 and a second portion 204*b* that is not secured to bottom 103. Second portion 204*b* can be routed through the corresponding bend locating ring 205 and pulled back on top of first portion 204*a* to thereby pull bend locating ring 205, and the portion of bottom 103 to which it is secured, towards the portion of bottom 103 on the opposite side of the interface. The presence of stiffeners 201 can ensure that the bend in bottom 103, which this pulling of bend locating ring 205 causes, will occur along the interface. First and second portions 204*a*, 204*b* can include hook and loop or any other suitable fastener 204*c* for securing second portion 204*b* to first portion 204*a*. In some embodiments, a loop or other gripping mechanism 204*b*1 may be formed at the end of second portion 204*b*. Any other suitable bend locating components or techniques could be used to locate a bend on inflatable 100. For example, a pair of bend locating rings could be positioned on opposing sides of the interface and held together with a clip, carabiner or other structure. As another example, opposing sides of a zipper could be positioned on opposing sides of the interface.

In some embodiments, bend maintaining components can be included on bottom 103 to maintain a bend in inflatable 100 after inflatable 100 is inflated such as during play. For example, bottom 103 may include one or more sets of bend maintaining rings 202*a* and 202*b* that are positioned on opposing sides of the interface between slide end 100*a* and ladder end 100*b* and corresponding bend maintaining straps 203. In some embodiments, each of bend maintaining rings 202*a* and 202*b* can be spaced equal distances from the interface such that, when ladder end 100*b* is oriented substantially perpendicular to slide end 100*a*, bend maintaining straps 203 will be positioned at approximately a 45-degree angle relative to bottom 103. However, in other embodiments, supporting rings 202*a* and 202*b* may be spaced at unequal distances from the interface. Of course, bend maintaining straps 203 or any other bend maintaining components could be used to create a bend of any angle between ladder end 100*b* and slide end 100*a*.

Figure 3D:
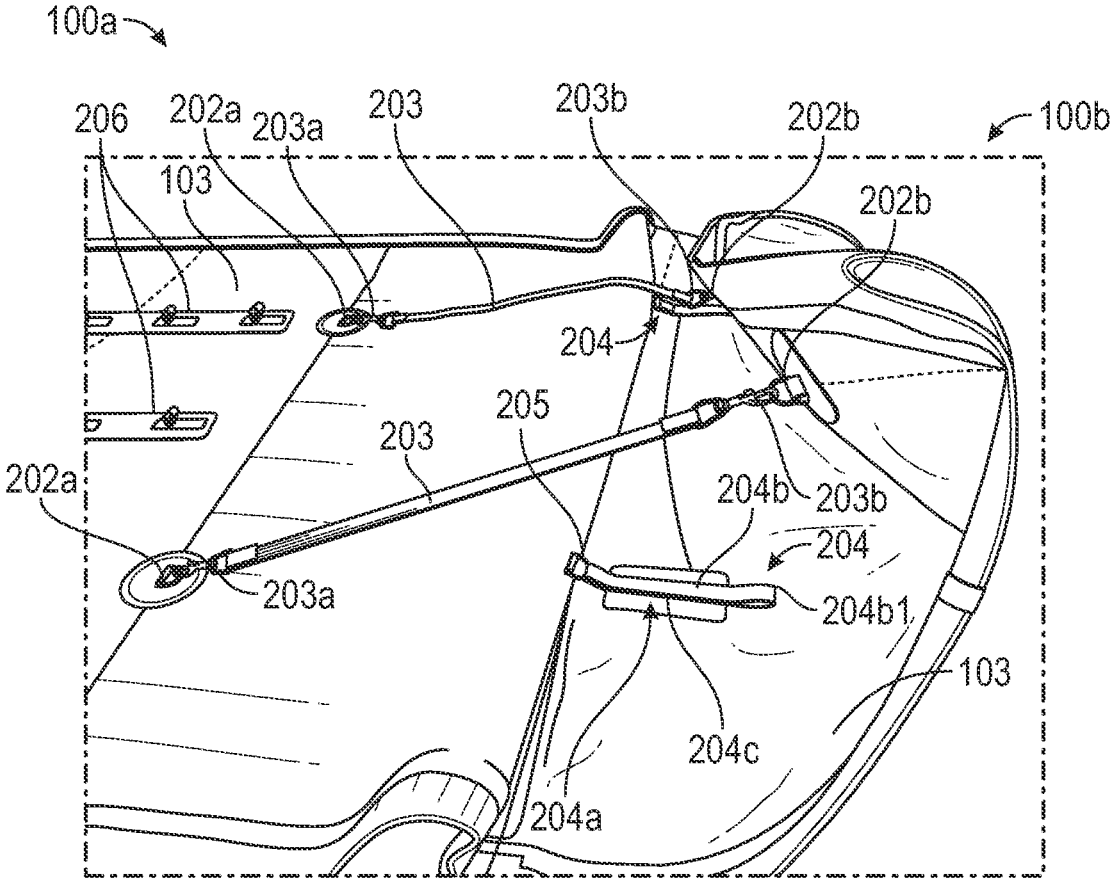

When in the mat configuration, bend maintaining straps 203 can be connected between bend maintaining rings 202*b* for storage. To transition to the slide configuration, bend maintaining straps 203 can be connected between pairs of bend maintaining rings 202*a* and 202*b* as shown in FIGS. 2B, 2C and 3D. Accordingly bend maintaining straps 203 can maintain the position/angle of ladder end 100*b* relative to slide end 100*a* and impart the tensile force required to prevent slide end 100*a* and ladder end 100*b* from springing open into a flat configuration. Each end of bend maintaining strap 203 can include a connector 203*a*, 203*b*. In some embodiments, connectors 203*a*, 203*b* can be rotatable to enable bend maintaining strap 203 to untwist if necessary. In some embodiments, the distance between bend maintaining rings 202*b* may substantially match the distance between the pairs of bend maintaining rings 202*a* and 202*b* when ladder end 100*b* is oriented substantially perpendicular to slide end 100*a*. In such embodiments, the length of bend maintaining straps 203 may match the distance between bend maintaining rings 202*b* as shown in FIG. 2A.

Forming the bend in the flat segment of inflatable 100 can cause added stress on sidewall 102. Accordingly, in some embodiments, a sidewall protector 207 may be secured (e.g., glued or welded) to sidewall 102 overtop the portions of sidewall 102 where the bend is formed. In some embodiments, sidewall protectors 207 may be secured to sidewall 102 prior to securing tape 104 overtop the seams. In such embodiments, tape 104 may be secured overtop sidewall protectors 207.

Bottom 103 may also include one or more tie off points 206 which can be used to secure slide end 100*a* to a boat or other structure. In the depicted example, three sets of three tie off points 206 are positioned across the width of bottom 103. Each tie off point 206 may accommodate a rope or other mechanism. Spacing tie off points 206 across slide end 100*a* facilitates securing inflatable 100 to a variety of boat configurations including a variety of cleat locations.

Figure 4A:
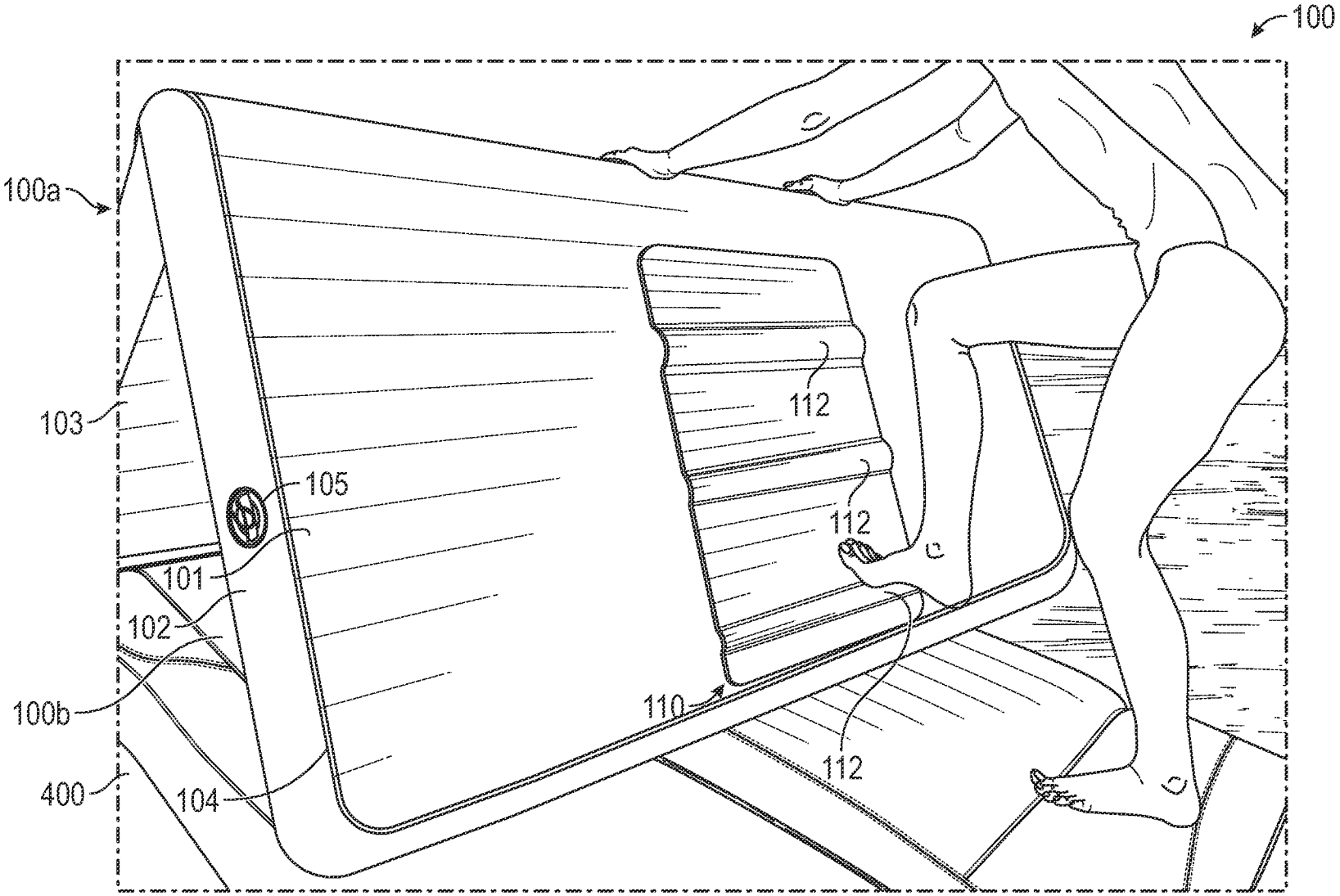
FIGS. 4A and 4B provide examples of an inflatable when used as a slide in accordance with one or more embodiments of the present invention.
Figure 4B:
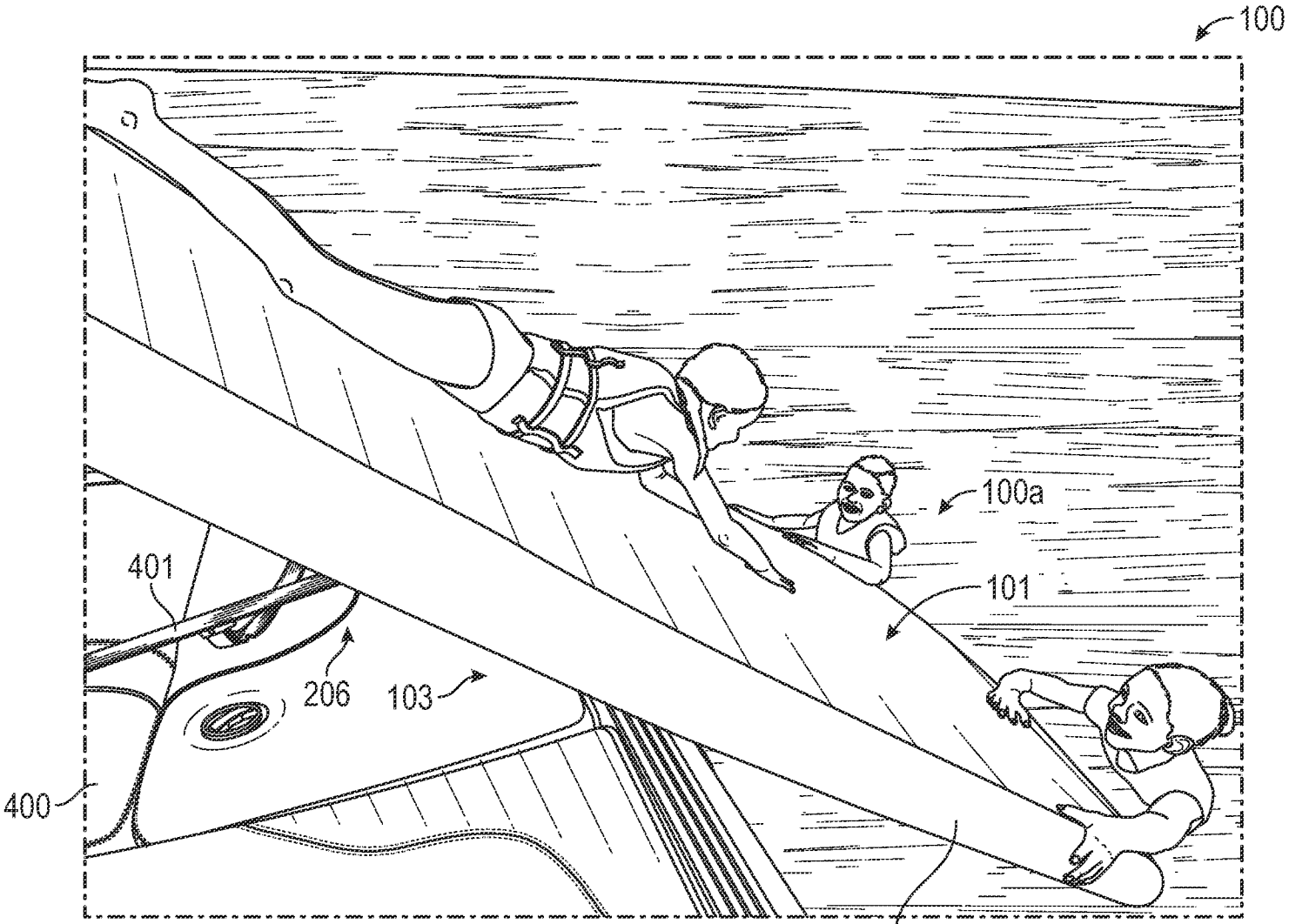

FIGS. 4A and 4B illustrate inflatable 100 when used in the slide configuration. As shown, inflatable 100 can be positioned with ladder end 100*b* on top of a boat 400 and slide end 100*a* extending towards the water. To facilitate climbing up ladder end 100*b*, pad 110 can include ridges 112. In some embodiments, pad 110 may be formed of foam (e.g., EVA foam), and ridges 112 can be thickened sections of the form that extend across the width of pad 110. As is visible in FIG. 4B, a rope 401 can be connected between boat 400 and one of tie off points 206 to secure slide end 100*a* to boat 400. Also, due to supporting straps 203, the angle between ladder end 100*b* and slide end 100*a* will not increase when individuals climb and slide down inflatable 100.

Figure 5A:
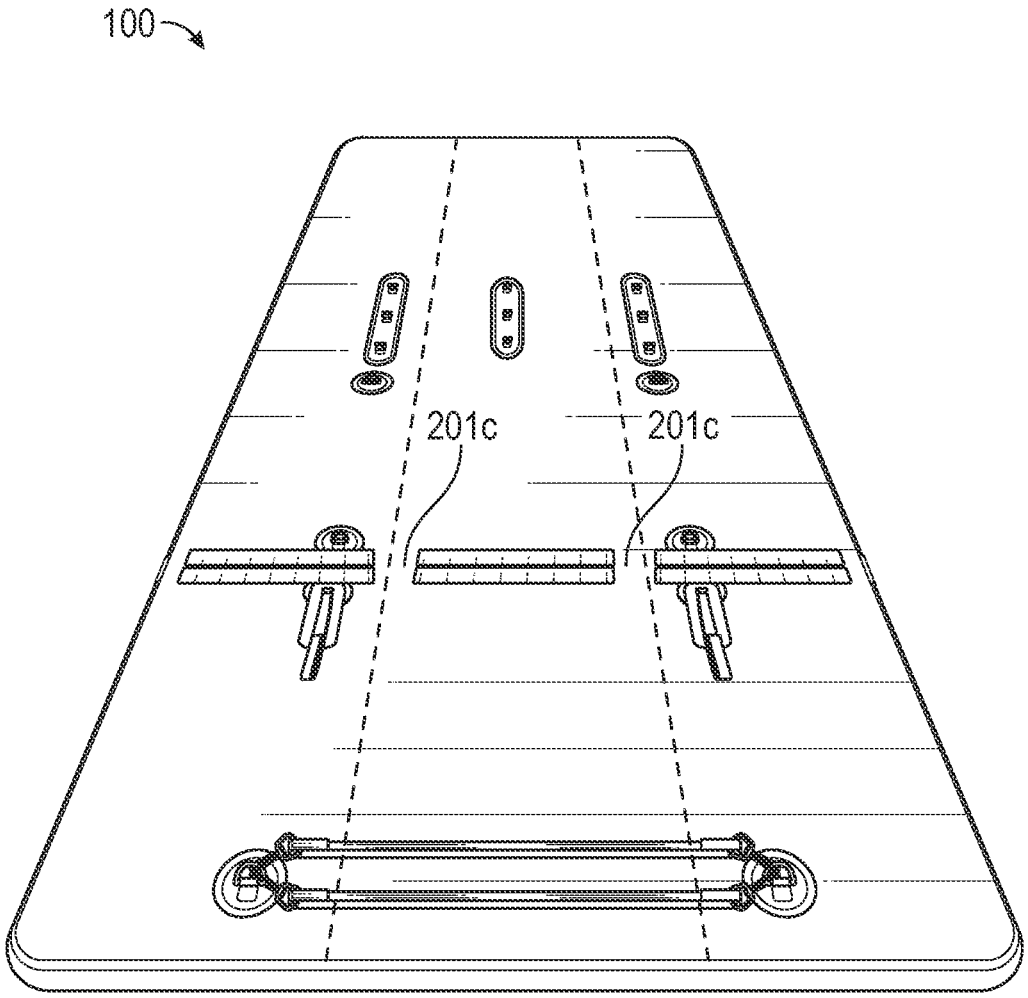
FIGS. 5A and 5B represent how an inflatable can be stored in accordance with one or more embodiments of the present invention.
Figure 5B:
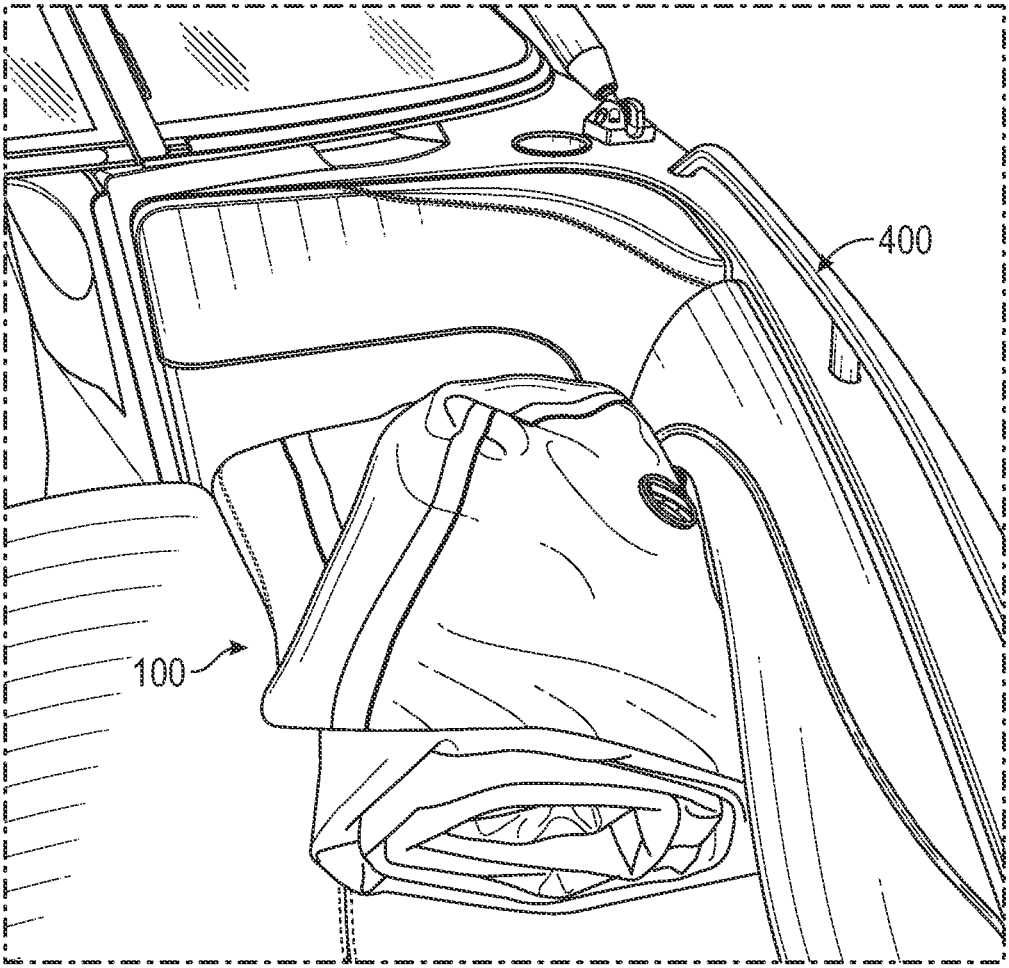

FIGS. 5A and 5B illustrate how inflatable 100 may be stored in one or more embodiments. As represented by the dashed lines, gaps 201*c* create fold lines along which inflatable 100 can be folded into thirds. Accordingly, when not inflated, inflatable 100 may be folded lengthwise along the fold lines and then rolled or folded widthwise. As shown in FIG. 4B, the folded and rolled inflatable 100 can then be stored on boat 400 without occupying excessive space. The figures represent embodiments where stiffeners 201 form two gaps 201*c*. In other embodiments, however, stiffeners 201 may form a single gap 201*c* (e.g., using only two sets of outer stiffeners 201*a*) or more than two gaps 201*c*. In some embodiments, the number of gaps 201*c* may be configured based on the width of inflatable 100.

Although the above description relates to a mat slide, embodiments of the present invention extend to other types of inflatables. For example, a bottom of any inflatable having one or more flat segments could include any or all of stiffeners 201, bend inducing strap(s) 204, bend inducing ring(s) 205, supporting strap(s) 203 and supporting ring(s) 202*a*, 202*b* for inducing and maintaining a straight bend at a desired location of the inflatable.

Embodiments of the present invention also encompass methods for locating and/or maintaining a bend in a flat segment of an inflatable. For example, to locate a bend in a flat segment of an inflatable, such as but not limited to a mat slide, an individual could insert a bend inducing strap through a bend inducing ring that is positioned on an opposite side of an interface between two portions of the flat segment of the inflatable. The individual could then pull the bend inducing strap back on top of itself to thereby cause a bend to be located at the interface when the flat segment of the inflatable is inflated. In some embodiments, regardless of whether a bend locating component is used, the individual may connect a bend maintaining strap between a pair of bend maintaining rings that are positioned on opposite sides of the interface to thereby maintain the bend while the inflatable is in use.

Figure 6:
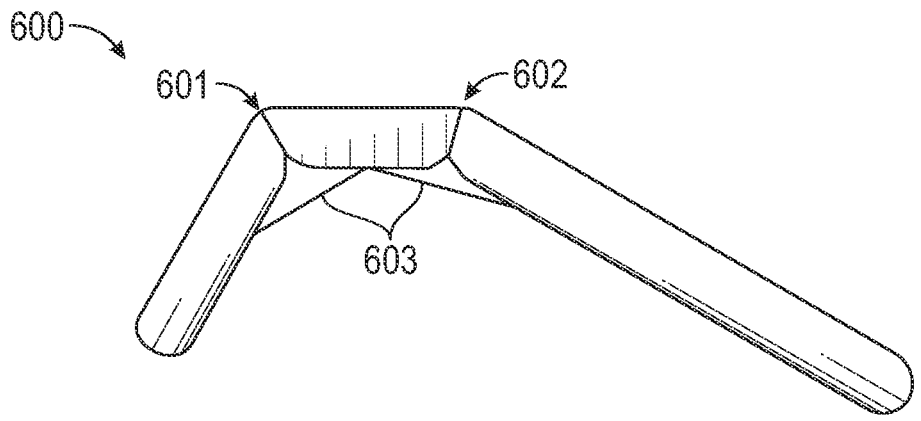
FIG. 6 illustrates how multiple bends may be formed in a flat segment of an inflatable in accordance with one or more embodiments of the present invention.

FIGS. 6-10 provide additional examples of how one or more bends may be maintained in one or more flat segments of an inflatable. FIG. 6 provides an example where an inflatable 600 with a single flat segment includes a first bend 601 and a second bend 602. One or more bend maintaining components 603 may be used to maintain first bend 601 and second bend 602. For example, bend maintaining components 603 could be one or more straps that are connected to the bottom surface of inflatable 600 on opposing sides of the corresponding bend.

Figure 7:
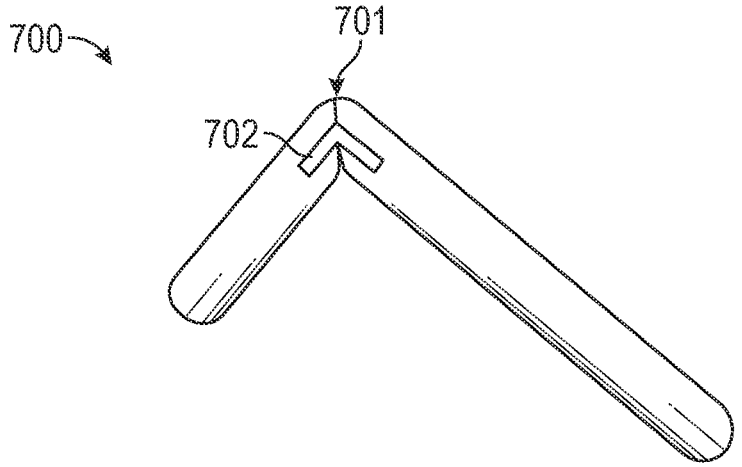
FIG. 7 illustrates how one or more bends may be maintained in a flat segment of an inflatable using one or more angle bars in accordance with one or more embodiments of the present invention.

FIG. 7 provides an example where an inflatable 700 with a single flat segment includes a bend 701 and bend maintaining components 702 in the form of angle bars. In particular, each side of inflatable 700 spanning the location where bend 701 is to be formed can be configured to receive an angle bar (e.g., by including a sleeve that is shaped to match the shape of the angle bar). With the angle bar in place, the opposing sides of inflatable 700 will be held at an angle matching the angle of the angle bar thereby maintaining the bend.

Figure 8:
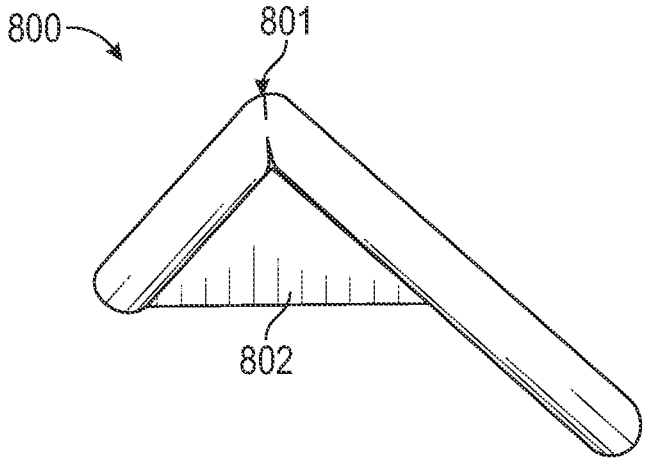
FIG. 8 illustrates how one or more bends may be maintained in a flat segment of an inflatable using one or more sheets of material in accordance with one or more embodiments of the present invention.

FIG. 8 provides an example where an inflatable 800 with a single flat segment includes a bend 801 and bend maintaining components 802 in the form of triangular sheets of material. In particular, the bottom surface of inflatable 800 can be configured to enable one or more triangular sheets of material to be secured on opposing sides of bend 801. The triangular shape of the sheet material can retain the opposing sides of inflatable 700 at an angle thereby maintaining the bend. Any other shape of sheet material could also be used.

Figure 9:
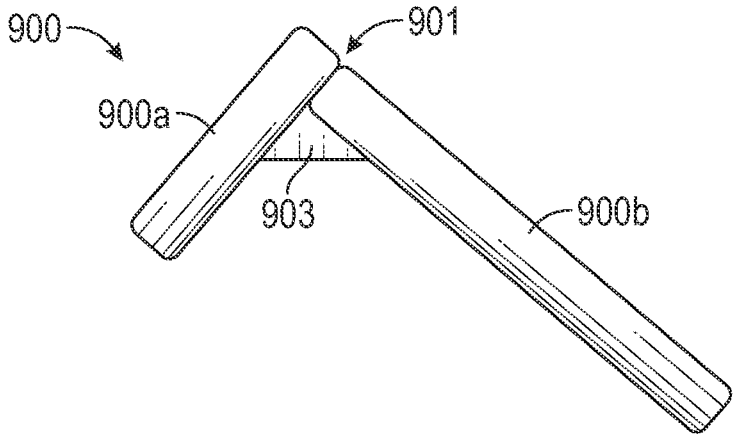
FIG. 9 illustrates how two or more inflatables having flat segments can be combined and oriented at an angle to form a ladder and slide in accordance with one or more embodiments of the present invention.

FIG. 9 provides an example where an inflatable assembly 900 is formed of two separate inflatables 900*a* and 900*b* that can be oriented at an angle 901. One or more bend maintaining components 903, which may be in any suitable form, can be used to maintain angle 901.

Figure 10:
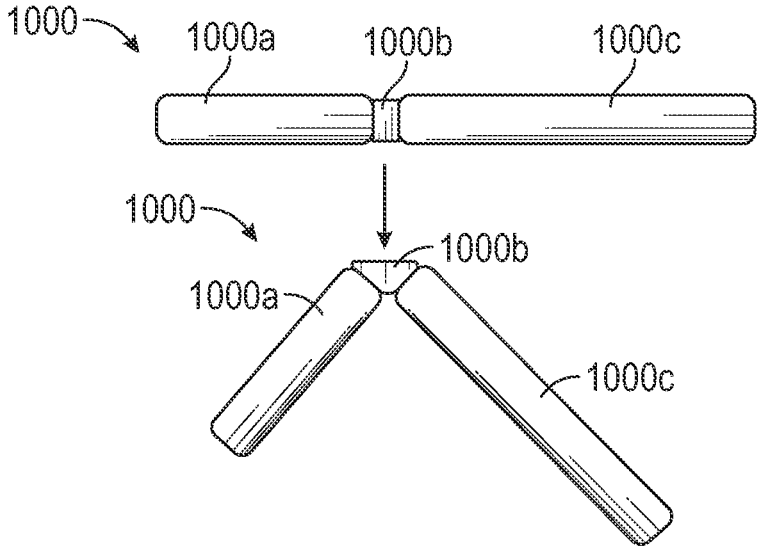
FIG. 10 illustrates how one or more bends may be maintained in a flat segment of an inflatable using one or more wedges in accordance with one or more embodiments of the present invention.

FIG. 10 provides an example where an inflatable 1000 includes a first flat segment 1000*a* that is connected to a second flat segment 1000*c* by a wedge 1000*b*. Wedge 1000*b* can be inflated separately from first flat segment 1000*a* and second flat segment 1000*b*. When wedge 1000*b* is uninflated (or at least not fully inflated), wedge 1000*b* will not force first flat segment 1000*a* and second flat segment 1000*b* to be angled. In other words, with wedge 1000*b* uninflated, first flat segment 1000*a* and second flat segment 1000*b* can lay flat. In contrast, when wedge 1000*b* is inflated, its shape will force first flat segment 1000*a* and second flat segment 1000*b* to be angled thereby replicating a bend. Therefore, wedge 1000*b* can function as a bend maintaining component when inflated.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. An inflatable comprising:

a flat segment having:

a top;

a bottom; and a sidewall that extends between the top and the bottom; and bend maintaining components for maintaining one or more bends including a first bend, the bend maintaining components including at least one pair of bend maintaining coupling points, each pair of bend maintaining coupling points being formed on the bottom on opposing sides of an interface between a first portion of the inflatable and a second portion of the inflatable, the bend maintaining components further including a bend maintaining coupling mechanism for each pair of bend maintaining coupling points, each bend maintaining coupling mechanism being configured to be selectively coupled between the respective pair of bend maintaining coupling points to maintain the first bend at the interface.

2. The inflatable of claim 1, further comprising:

one or more additional flat segments each having:

a top;

a bottom; and a sidewall that extends between the top and the bottom.

3. The inflatable of claim 1, wherein each bend maintaining coupling mechanism is removable to cause the flat segment to remain flat.

4. The inflatable of claim 1, wherein each bend maintaining coupling mechanism is a bend maintaining strap.

5. The inflatable of claim 1, further comprising:

one or more tie off points secured to the bottom of the flat segment.

6. The inflatable of claim 1, further comprising:

one or more sidewall protectors positioned on or in the sidewall of the flat segment at a location of the first bend.

7. An inflatable comprising:

a top;

a bottom;

a sidewall that extends between the top and the bottom; and at least one bend maintaining component that maintains a first bend, the first bend creating a slide portion and a ladder portion.

8. The inflatable of claim 7, further comprising:

a pad secured to the top on the ladder portion, the pad forming a ladder on the ladder portion.

9. The inflatable of claim 7, wherein each bend maintaining component is removable to cause the inflatable to remain flat.

10. The inflatable of claim 7, wherein each bend maintaining component is a bend maintaining strap.

11. An inflatable comprising:

a top;

a bottom;

a sidewall that extends between the top and the bottom;

one or more bend maintaining components for maintaining one or more bends including a first bend; and one or more pairs of bend locating components positioned on the bottom at an interface between a first portion of the inflatable and a second portion of the inflatable, each pair of bend locating components including a first bend locating component positioned on a first side of the interface and a second bend locating component positioned on a second side of the interface opposite the first side, the first and second bend locating components being configured to selectively couple together to induce the first bend at the interface.

12. The inflatable of claim 11, wherein the one or more bend maintaining components comprise one or more angle bars in the sidewall for maintaining the one or more bends in the flat segment.

13. The inflatable of claim 11, wherein the one or more bend maintaining components comprise one or more sheets of material for maintaining the one or more bends in the flat segment.

14. The inflatable of claim 13, wherein the one or more sheets of material have a triangular shape.

15. The inflatable of claim 11, further comprising:

an additional flat segment;

wherein the one or more bend maintaining components comprise one or more wedges that connect the flat segment to the additional flat segment.

16. The inflatable of claim 11, wherein the one or more bend maintaining components maintain more than one bend in the flat segment.

17. The inflatable of claim 11, wherein the first and second bend locating components of at least one of the one or more pairs of bend locating components comprise one of:

a bend locating strap and corresponding bend locating ring;

a pair of bend locating rings; or opposing sides of a zipper.

18. An inflatable comprising:

a flat segment having:

a top;

a bottom; and a sidewall that extends between the top and the bottom;

one or more bend maintaining components for maintaining one or more bends; and one or more bend locating components comprising:

one or more bend locating straps secured to the bottom of the flat segment and positioned at an interface between a first portion of the flat segment and a second portion of the flat segment; and one or more bend locating rings secured to the bottom of the flat segment and positioned at the interface opposite the one or more bend locating straps, wherein the one or more bend locating straps and the one or more bend locating rings are configured to locate a bend in the flat segment of the inflatable along the interface.

19. The inflatable of claim 18, wherein the one or more bend maintaining components for maintaining the one or more bends comprise one or more bend maintaining straps that are positioned on the bottom of the flat segment.

20. An inflatable comprising:

a flat segment having:

a top;

a bottom; and a sidewall that extends between the top and the bottom;

one or more bend maintaining components for maintaining one or more bends;

pairs of stiffeners that are secured to the bottom of the flat segment and positioned on opposite sides of at least one of the one or more bends, the pairs of stiffeners being spaced apart to create at least one gap for accommodating a fold line.

* * * * *